US007347073B2

(12) United States Patent
Denker

(10) Patent No.: US 7,347,073 B2
(45) Date of Patent: Mar. 25, 2008

(54) ROLLING MILL STAND FOR THE ROLLING OF DIFFERENT ROLLED STOCKS WHICH REQUIRE DIFFERENT ROLLING FORCES

(75) Inventor: Wolfgang Denker, Freudenberg (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 75 days.

(21) Appl. No.: 10/486,170

(22) PCT Filed: Aug. 16, 2002

(86) PCT No.: PCT/EP02/09195

§ 371 (c)(1),
(2), (4) Date: Feb. 3, 2004

(87) PCT Pub. No.: WO03/020452

PCT Pub. Date: Mar. 13, 2003

(65) Prior Publication Data

US 2004/0187538 A1 Sep. 30, 2004

(30) Foreign Application Priority Data

Aug. 22, 2001 (DE) ..... 101 41 180

(51) Int. Cl.
*B21B 31/07* (2006.01)
*B21J 9/18* (2006.01)

(52) U.S. Cl. ..... 72/245; 72/453.02; 72/453.05; 72/453.08

(58) Field of Classification Search ..... 72/245, 72/248, 453.02, 453.05, 453.08, 241.8; 100/269.05–269.08, 269.1, 269.18; 92/52; 91/169

See application file for complete search history.

(56) References Cited

U.S. PATENT DOCUMENTS

| | | | | |
|---|---|---|---|---|
| 2,027,283 | A * | 1/1936 | McFadden | 72/246 |
| 4,041,752 | A * | 8/1977 | Dolenc et al. | 72/201 |
| 4,167,107 | A * | 9/1979 | Simmonds | 72/239 |
| 4,669,294 | A * | 6/1987 | Wilson | 72/249 |
| 4,907,439 | A * | 3/1990 | Diel et al. | 72/247 |
| 5,142,892 | A * | 9/1992 | Noe et al. | 72/19.9 |
| 5,234,187 | A * | 8/1993 | Teppo et al. | 248/161 |
| 5,809,821 | A * | 9/1998 | Figge | 72/247 |

FOREIGN PATENT DOCUMENTS

| | | |
|---|---|---|
| CH | 399 161 | 3/1966 |
| DE | 40 10 662 | 10/1991 |
| EP | 0 618 019 | 10/1994 |
| JP | 60162513 | 8/1885 |
| JP | 62130705 | 6/1987 |

* cited by examiner

*Primary Examiner*—Derris H. Banks
*Assistant Examiner*—Teresa M Bonk
(74) *Attorney, Agent, or Firm*—Andrew Wilford

(57) ABSTRACT

A rolling mill frame for the rolling of different rolled stock which requires different rolling forces and which has working rolls, back-up rolls, optionally a roll being device for the working rolls and optionally a device for adjusting and balancing the back-up rolls. The mill has pairs of adjusting cylinders between the roll stand and the chocks of the rolls which avoid large friction losses. The adjusting cylinders are each comprised of a telescoping cylinder in which a first cylinder with a large diameter for high rolling forces and a concentric cylinder with smaller diameter for smaller rolling forces are provided.

5 Claims, 2 Drawing Sheets

ROLLING MILL STAND FOR THE ROLLING OF DIFFERENT ROLLED STOCKS WHICH REQUIRE DIFFERENT ROLLING FORCES

CROSS REFERENCE TO RELATED APPLICATIONS

This application is a national stage of PCT/EP02/09195 filed 16 Aug. 2002 and based upon German national application 101 41 180.4 of 22 Aug. 2001 under the International Convention.

FIELD OF THE INVENTION

The present invention relates to a rolling mill stand for the rolling of different kinds of rolled stock which require different rolling forces and having a lower working roll and an upper working roll, back up rolls juxtaposed with the working rolls, optionally a roll bending device for the working rolls, and optionally devices for the setting and balancing of the back up rolls and pairs of adjusting cylinders between the roll stands and the chocks.

BACKGROUND OF THE INVENTION

The hydraulic adjusting cylinders are used to generate the rolling force in the rolling mill. For the rolling mill a high product selectivity requires that the rolling mill be capable of having large rolling force differences between the individual products which are to be produced by a given rolling mill stand.

It is known to apply the different rolling forces with two adjusting cylinders for each rolling mill stand. In this case, however, the production of a lower rolling force may involve the same friction losses as a higher rolling force which can give rise to difficulties in control. A greater part of the higher friction losses may contribute to loading of the seals, the piston rod and the piston in a piston-and-cylinder unit.

To adjust the rolling force in a rolling mill stand, especially in a strip rolling mill stand for hot or cold rolling, it is known (DE 40 10 662 C2), in maintaining in a simple way the percentage of rolling force fluctuations in the course of rolling force control over an entire rolling force range, so as to be exceptionally small, to provide both adjusting cylinders with a respective cylinder housing and a cylinder pin, with a hat-shaped piston which is guided in a cylinder collar and in which the central piston surface formed by the internal hat button and the annular piston surface formed by the peripheral rim of the hat shaped piston are subjected to the pressure medium independently from one another or individually, or in common. This system, however, provides a plurality of friction surfaces which can complicate the control of the system.

OBJECT OF THE INVENTION

The invention has as its object to reduce such friction losses and thereby enable a more precise control.

SUMMARY OF THE INVENTION

The object which has been set forth is achieved according to the invention in that setting cylinders each are comprised of a telescoping cylinder in which a first concentric cylinder is provided with a larger diameter for producing higher rolling forces and a second concentric cylinder is provided with a smaller diameter for producing smaller rolling forces.

In this case friction forces arise only at the seals between the cylinder and the respective pistons. The friction losses are as a result smaller as a whole and thus allow a more precise control of the rolling force.

As a development of this basic concept it is proposed that the first larger cylinder with the greater diameter, form an outer annular pressurizable compartment whose pressure medium presses a larger piston ring against the cylinder bottom. The advantage is that the larger piston, during the actuation of the smaller piston, finds itself in a rest position and with smaller rolling forces, the friction at the larger piston can be completely eliminated so that friction only arises at the smaller piston which is substantially reduced.

In a refinement of the invention it is provided that the smaller piston of the second cylinder with the smaller diameter form within the larger piston a pressurizable compartment for the actuation of the smaller piston. This allows use of an advantage of the telescoping system, which is connected with a significant space saving.

A further feature of the invention provides that the pressure medium connection for the smaller cylinder extends through the cylinder wall and through the cylinder bottom of the larger cylinder. The advantage resides in a shorter medium line and in a separation of the pressure medium connections to two sides of the setting cylinder.

In a further refinement it is proposed that the pressure medium connection for the annular pressurizable compartment of the larger piston form a connection to the underside of the smaller piston. This also leads to a saving in the space required for the structure.

A short medium line also can result when the first or larger cylinder has a fluid medium connection opening in the region of the cylinder bottom. This can support the concept that the larger piston can remain in a rest position in which only the smaller piston is actuated for smaller rolling forces.

A further advantageous refinement has the first or larger cylinder so that it can be closed by means of a closure ring sealing the larger piston and defining an outer annular pressurizable compartment to which a fluid medium fitting for that outer compartment is connected. The closure ring can receive the sealing ring which seals against the larger piston and in part defines the annular pressurizable compartment.

SPECIFIC DESCRIPTION

Figure 1:
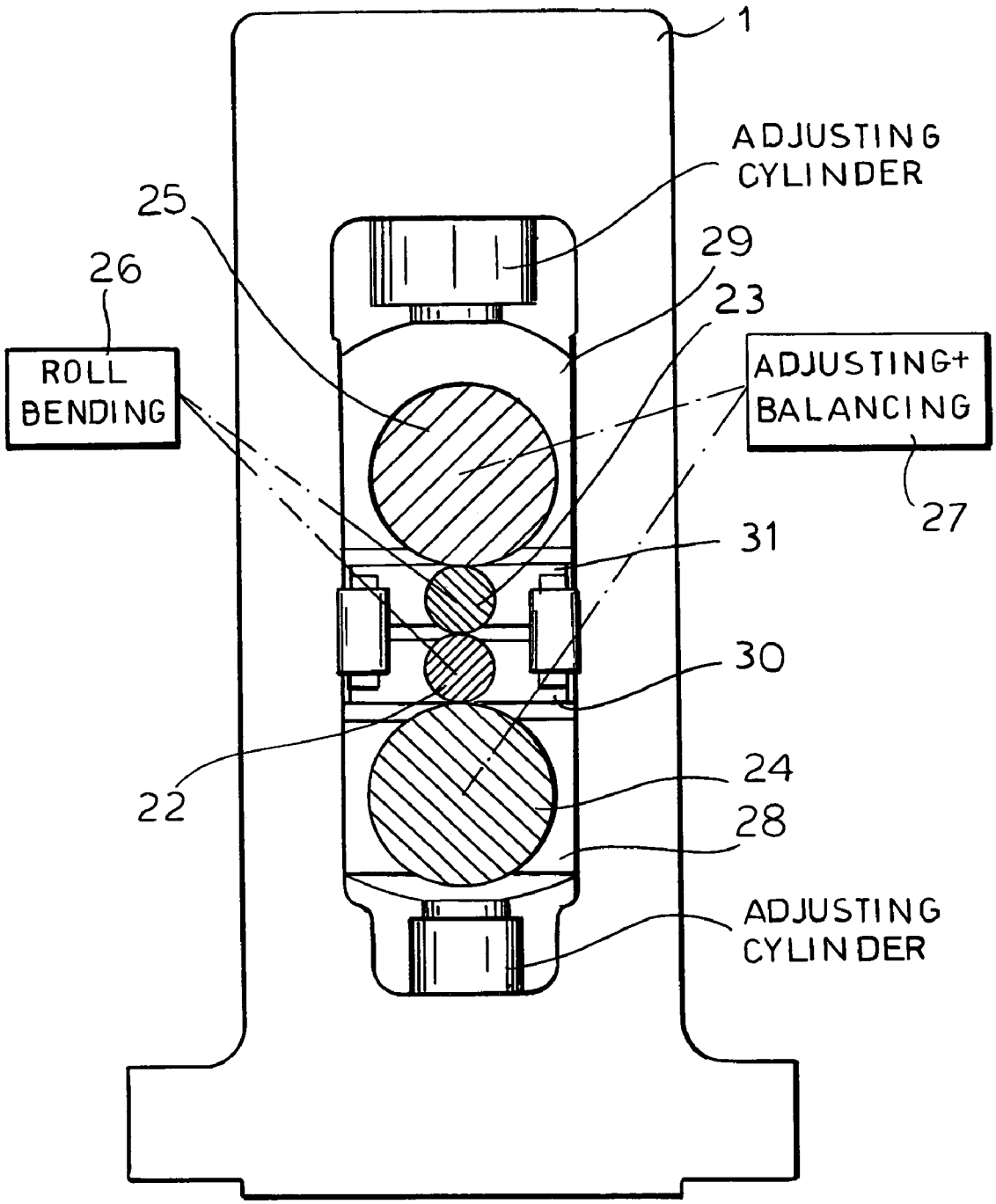
FIG. 1 is a side elevation view (with the rolls shown in section) of a rolling mill according to the invention.

In FIG. 1 of the drawing a rolling mill stand 1 has been shown for the rolling of different rolled stock which may require different rolling forces and which can receive upper and lower working rolls, not illustrated in detail, the back-up rolls juxtaposed with the working rolls, optionally a roll bending device 26 for the working rolls 22, 23, and optionally devices 27 for adjusting and balancing the back-up rolls 24, 25. The rolls can have chocks 28, 29, 30 and 31. Pairs of adjusting cylinders 3 can be provided between the roll stand 1 and a chock 2.

Figure 2:
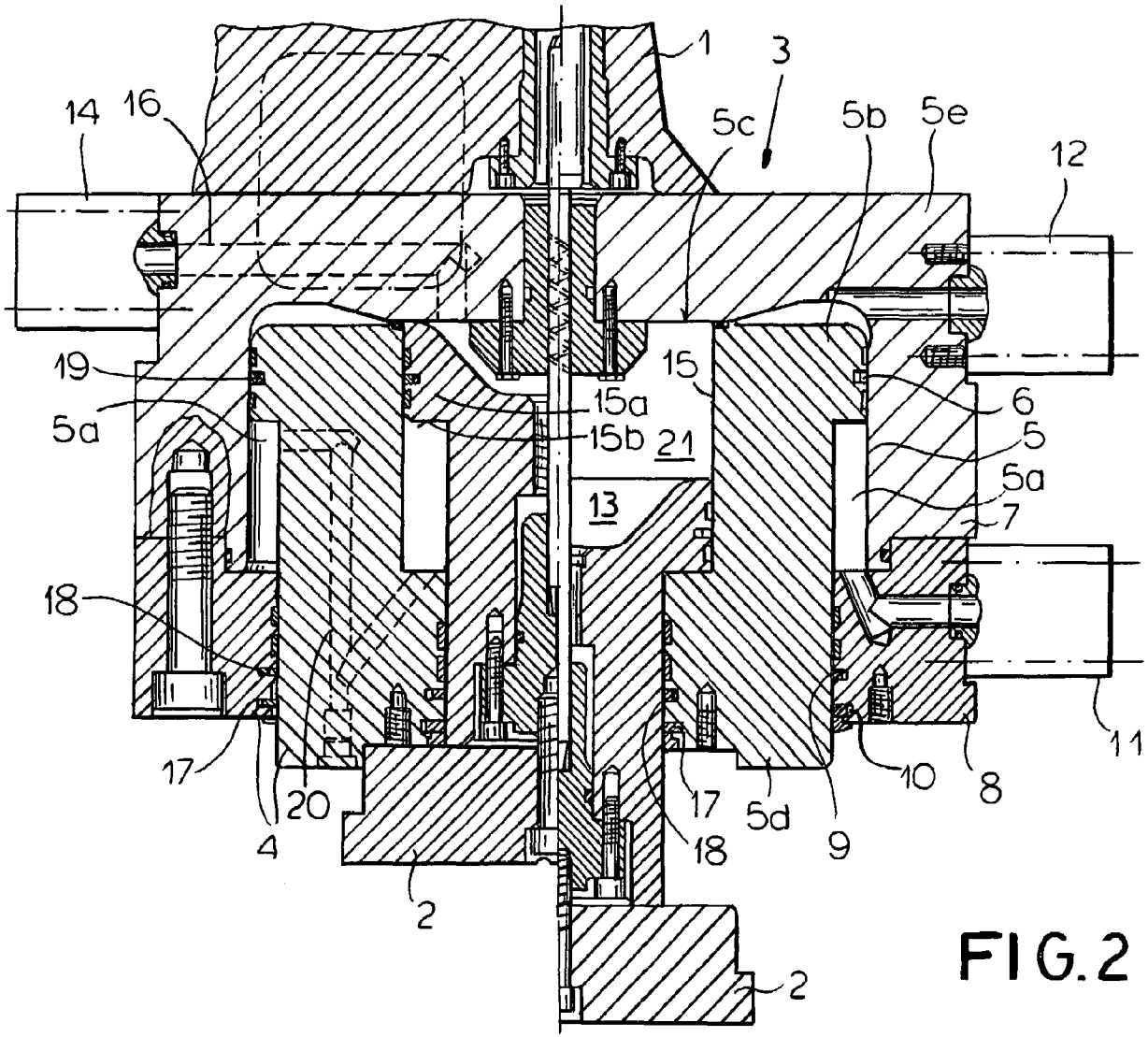
FIG. 2 is a cross section through an adjusting cylinder for such a rolling mill.

The adjusting cylinders 3 (FIG. 2) are each comprised of a telescoping cylinder 4. In each of the telescoping cylinders 4 there is a respective first larger cylinder 5 with an outwardly lying annular pressurizable compartment 5*a* which is defined by a larger piston ring 5*b*. The larger piston 5*d* is sealed by means of a larger annular seal 6 in the cylinder housing 7.

There below the cylinder housing 7 is closed by means of a closure ring 8 which also has annular seals 9 and 10 which seal against the larger diameter piston 5*d*. Upon pressurization through the hydraulic fitting 11 opening into the annular pressurizable compartment 5*a*, the larger diameter piston 5*d* is displaced against the cylinder bottom 5*c* as has been illustrated. The fluid pressure on the opposite side which would amount to a counterpressure, is drained via the pressure fitting 12. Within the first larger diameter piston 5*d*, a pressurizable compartment 13 is formed which can be pressurized by the fitting 14. The pressure compartment 13 receives a second smaller diameter cylinder 15 which slides in the larger diameter piston 5*d* and which encloses a second smaller diameter piston 15*a*. The fluid pressure fitting 14 communicates with the pressurizable compartment 13 via a fluid medium passage 16 which runs through the upper region of the cylinder housing 7. The second smaller piston 15*a* is sealed by corresponding sealed rings 17 and 18 whose diameter is smaller than the second smaller cylinder 15. A further sealing ring 19 is located on the smaller piston 15*a* within the larger piston 5*d*. The pressure medium fitting 14 feeds the hydraulic fluid through the cylinder wall 5*e* and through the cylinder bottom 5*c*.

In the left half of the illustration (FIG. 2), the smaller piston 15*a* is shown in its upper position and in the right half of the illustration in its lower position.

The fluid medium fitting 11 provides a communication 20 for the larger annular pressurizable compartment 5*a* to the underside 15*b* of the smaller piston 15*a*.

The smaller piston 15*a* of the second smaller cylinder 15 forms in its interior 21 the pressurizable compartment 13 for actuation of this smaller piston 15.

The invention claimed is:

1. A rolling mill stand for rolling stock that requires high and low rolling forces, the stand comprising:

a frame;

a lower working roll in the frame;

an upper working roll in the frame above the lower working roll;

respective upper and lower backup rolls in the frame respectively bearing downward and upward on the upper and lower working rolls;

chocks supporting the backup rolls in the frame;

respective upper and lower pairs of telescoping adjusters between the frame and the chocks of the backup rolls, the telescoping adjusters each comprising a large-diameter outer cylinder for the high rolling forces, a large-diameter outer piston in the large-diameter outer cylinder, defining therewith a substantially closed outer annular large-diameter chamber pressurizable to press the large-diameter outer piston in one direction against a bottom of the large-diameter outer cylinder, and in turn defining a concentric small-diameter inner cylinder for the low rolling forces, and a small-diameter inner piston forming in the concentric small-diameter inner cylinder in the large-diameter outer piston with the bottom of the large-diameter outer cylinder a small-diameter first compartment separate from and not a connected to the outer large-diameter chamber and serving to shift the small-diameter inner piston in the small-diameter inner cylinder in a direction opposite the one direction;

means including a first pressure-medium fitting extending through the large-diameter outer cylinder and opening into the outer large-diameter chamber for pressurizing the outer large-diameter chamber and pressing the large-diameter outer piston in the one direction against the cylinder bottom; and means including a second pressure-medium fitting extending through the bottom of the large-diameter outer cylinder and opening into the small-diameter first compartment for pressurizing the small-diameter first compartment.

2. The rolling mill stand defined in claim 1 wherein the first pressure-medium fitting of the large-diameter outer cylinder opens in a region of the cylinder bottom.

3. The rolling mill stand defined in claim 1 wherein the outer large-diameter outer cylinder is closable by means of a closure ring sealing relative to the large-diameter outer piston and to which the pressure medium fitting for the outer large-diameter chamber is connected.

4. The rolling mill stand defined in claim 1 wherein the inner piston defines with the outer piston an annular small-diameter second compartment pressurizable to press the small-diameter piston in the one direction against the bottom of the large-diameter cylinder.

5. The rolling mill stand defined in claim 4, further comprising a passage extending between the large-diameter outer chamber and the annular small-diameter second compartment for feeding pressure from the outer chamber to the annular small-diameter second compartment, an effective surface area of the inner piston in the annular small-diameter second compartment being smaller than an effective surface area of the inner piston in the first compartment.

* * * * *